US005941118A

United States Patent [19]

Tseng

[11] Patent Number: 5,941,118

[45] Date of Patent: Aug. 24, 1999

[54] DIE FORGING METHOD FOR METALLIC HOLLOW PIPES

[76] Inventor: Shao-Chien Tseng, No. 130, Sec. 2. Yang-Shin Rd., Yang-Mei Taoyuan 326, Taiwan

[21] Appl. No.: 09/025,493

[22] Filed: Feb. 18, 1998

Related U.S. Application Data

[63] Continuation-in-part of application No. 08/798,970, Feb. 11, 1997, abandoned.

[51] Int. Cl.[6] ..... B21D 51/02

[52] U.S. Cl. ..... 72/370.04; 72/398

[58] Field of Search ..... 72/370.04, 370.23, 72/398, 471; 164/369

[56] References Cited

U.S. PATENT DOCUMENTS

| | | | |
|---|---|---|---|
| 1,339,970 | 5/1920 | Murray et al. | 72/370.04 |
| 1,693,487 | 11/1928 | Mansfield . | |
| 2,821,012 | 1/1958 | Rzezutko et al. . | |
| 2,841,082 | 7/1958 | Kirkpatrick . | |
| 3,964,534 | 6/1976 | Rabinowitz | 164/369 |
| 4,186,586 | 2/1980 | Takamura et al. . | |
| 4,270,690 | 6/1981 | Mabery et al. . | |

*Primary Examiner*—Lowell A. Larson
*Attorney, Agent, or Firm*—Pro-Techtor International Services

[57] ABSTRACT

A method for forging a die core with a given shape for manufacturing metallic hollow pipes with a thin wall, the method is completed by using a hollow can shaped plastic film loaded with a filler, the plastic film is endued with embossment in conformity with the shape of a desired shaped pipe wall; the filler can be chosen from three kinds, i.e., the liquid, plastic and heat resistant fillers, to be filled in the plastic film, an opening of the plastic film is then sealed; fast freeze the liquid filler to form a frozen die core, cool the plastic filler to form a plastic die core, or insert a heat resistant steel post in the heat resistant filler and then bake or sinter to harden it to shape the heat resistant die core for hot forging. By such method, a die core for use in cold or hot forging can be placed in a pipe hole of a metallic pipe casting, and suits die moulding by the cold or hot forging, the pipe wall of the casting thus is forged to form an embossed wall conformed in shape to the embossed plastic film, and the die core can be easily taken out of the shaped and embossed pipe after the cold or hot forging.

6 Claims, 7 Drawing Sheets

DIE FORGING METHOD FOR METALLIC HOLLOW PIPES

This is a continuation-in-part applicaton of applicant's U.S. patent application Ser. No. 08/798,970, filed on Feb. 11, 1997 now abandoned.

BACKGROUND OF THE INVENTION

1. Field of the Invention

The present invention relates to a method for forging a die core with a given shape for manufacturing metallic hollow pipes with a thin wall, and especially to a method suitable for die forging by cold/hot forging process, wherein, a metallic pipe casting having a round pipe wall is forged by cold/hot forging process to form a pipe with an embossed pipe wall. And more especially to the process of forging on a metallic hollow pipe with a thin wall having a complicated artistic contour, it can be easily practised to form a shaped die core by using the technique of the present invention; and after completion of forging, the die core in the pipe hole can be easily removed.

2. Description of the Prior Art

Forging thechniques available in the art of forging are divided into cold and hot forging modes: cold forging 20 is that a given die is used under a normal temperature to press and forge metallic castings as finished products having the required shape; while hot forging is that metallic castings are preheated in a given temperature and then are pressed and forged to form finished products having the required shape; it can be seen that, crystal texture of metallic castings themselves before cold forging is not damaged, while crystal texture of metallic castings themselves before hot forging is softened during heating process; so that as to forge strength, the required forging pressure for a die used in hot forging castings is smaller than that in cold forging, hence the required finished products can be forged gradually in sequence; however, as to the metallic strength of the required finished products, the-finished products formed by cold forging is better than those formed by hot forging; in this view, the mode that metal castings are formed by cold or hot forging is decided by factors such as the metallic strength of the required finished products, the forge strength of the workpiece to be processed and the texture of the metals.

Besides, the above mentioned metallic castings can be solid metallic or hollow metallic castings no matter a cold or a hot forging process is used, however, they can be very distinctive in forging techniques; taking the round castings as an example, a solid casting is called a metallic stick (such as those made by the solid iron stick swaging technique of the U.S. Pat. No. 4,186,586), and a hollow casting is called a metallic pipe (such as those made by the hollow iron pipe rolling forging technique of the U.S. Pat. No. 1,693,487), the techniques which are very different are chosen depending on whether the finished products are hollow.

As is known in the forging technique of the U.S. Pat. No. 4,186,586, the technique of pushing of fluid or sand creating equalized pressure for swaging to form a solid iron stick can not be used to forge a hollow pipe with an embossed pipe wall.

By the fact that a solid iron stick does not have a hollow pipe hole, it needs no die, besides, the fluid or the sand is used to be pushed to flow, it is completely different from the fillers filled in the plastic film of the present invention capable of being shaped by freezing or sintering.

In the forging technique of the U.S. Pat. No. 1,693,487, rolling forging is executed on a pipe workpiece covered by a soft pipe and filled in the pipe wall thereof with sand by using a rolling forging equipment, wherein, the article to be manufactured is a round pipe with a reduced diameter rather than an embossed pipe with a clear embossed contour on the pipe wall thereof, so that it is different as to the workpiece as well as to the equipment and the method used for manufacturing, the measures using sand to form a die in the pipe wall provides less plasticity, and only is suitable for use in rolling forging a hollow round pipe; if the measures using sand to form a die is applied on the die core used for forging an embossed pipe of the present invention, a problem of unability in being shaped in a casting hole a desired embossed contour may rise, besides, sand is inferior in resisting forging pressure to other kinds of shaped die cores of the present invention; therefore, the forging technique is different from that of the present invention too.

Accordingly, whichever of the cold and hot forging techniques of the conventional art is used, it is hard to forge a hollow pipe with an embossed pipe wall; the point is that, no matter the embossed contour is shaped on a die cavity or a die core in advance, when in completion of the forging and in taking the workpiece out of the die, the die core is stuck with the shaped but plastically deformed embossed pipe wall, and thereby is hard to be taken out.

SUMMARY OF THE INVENTION

In view that there is no preferred die core for forging a metallic embossed pipe and especially for forging a metallic artistic embossed pipe, the present invention therefore is provided after study and developing, the object of the present invention is described as follows:

Die cores with given shapes manufactured by using low cost shaped plastic films and various fillers and being respectively adapted to the cold and hot forging techniques can not only resist forging pressure exerted on the walls of castings and allow the walls of the castings to plastically deform to form the shaped pipe walls with embossed contours, but also allow simple and easy detachment of the die cores to reveal the embossed contours of the forged and shaped pipe holes.

In order to achieve the above stated object, the method for manufacturing a die core of the present invention includes the points as follows:

1. A hollow can shaped plastic film with an artistic embossed contour is formed of PET or PVC plastic material and by the vacuum injection forming technique, the embossed contour formed can be very widely applied, this meets the requirement in forging an artistic embossed pipe, while cost of processing as well as material consumption is extremely low.

2. Before cold or hot forging, the three kinds of die cores with given shapes designed in the present invention can be frozen, melted and sintered depending respectively on the natures of the fillers used to endue the die cores having the embossed contours with resistive strength against the forging pressures.

3. After the cold or hot forging, the three kinds of die cores with given shapes designed in the present invention can be defrozen, melting shrinked and shaking etc. depending respectively on the natures of the fillers used and after they are cut to remove their seals, they are taken out of the forged and shaped pipe walls having the embossed contours easily to reveal the embossed contours of the forged and shaped pipe walls.

The present invention will be apparent after reading the detailed description of its preferred embodiments in reference to the accompanying drawings.

DETAILED DESCRIPTION OF THE PREFERRED EMBODIMENT

Figure 1:
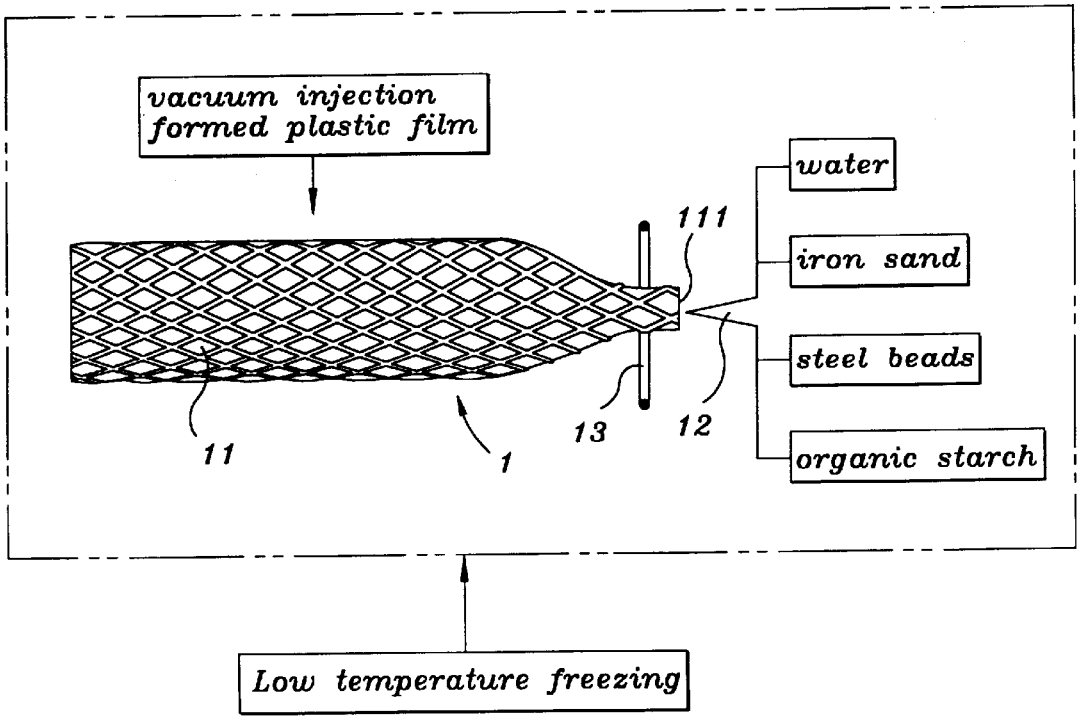
FIG. 1 is a process chart showing using of a frozen die core in the cold forging process of the present invention.
Figure 2:
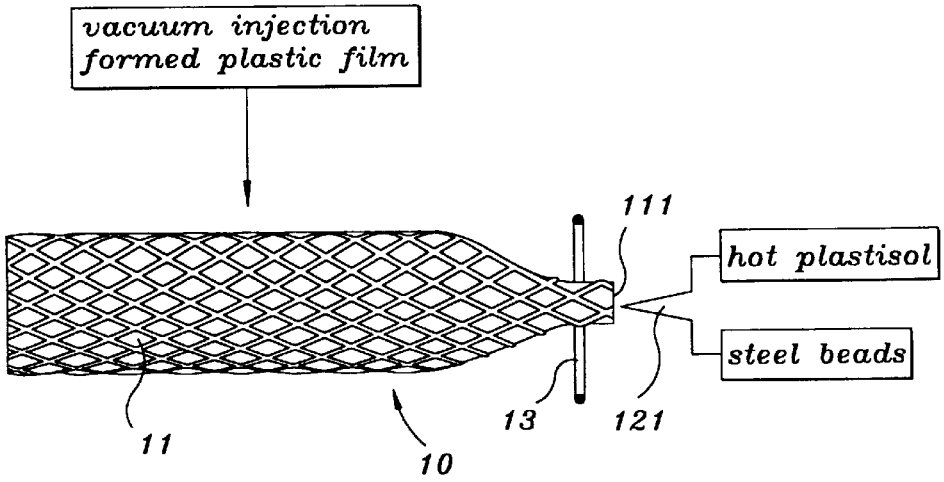
FIG. 2 is another process chart showing using of a die core filled with plastisol in the cold forging process of the present invention.
Figure 11:
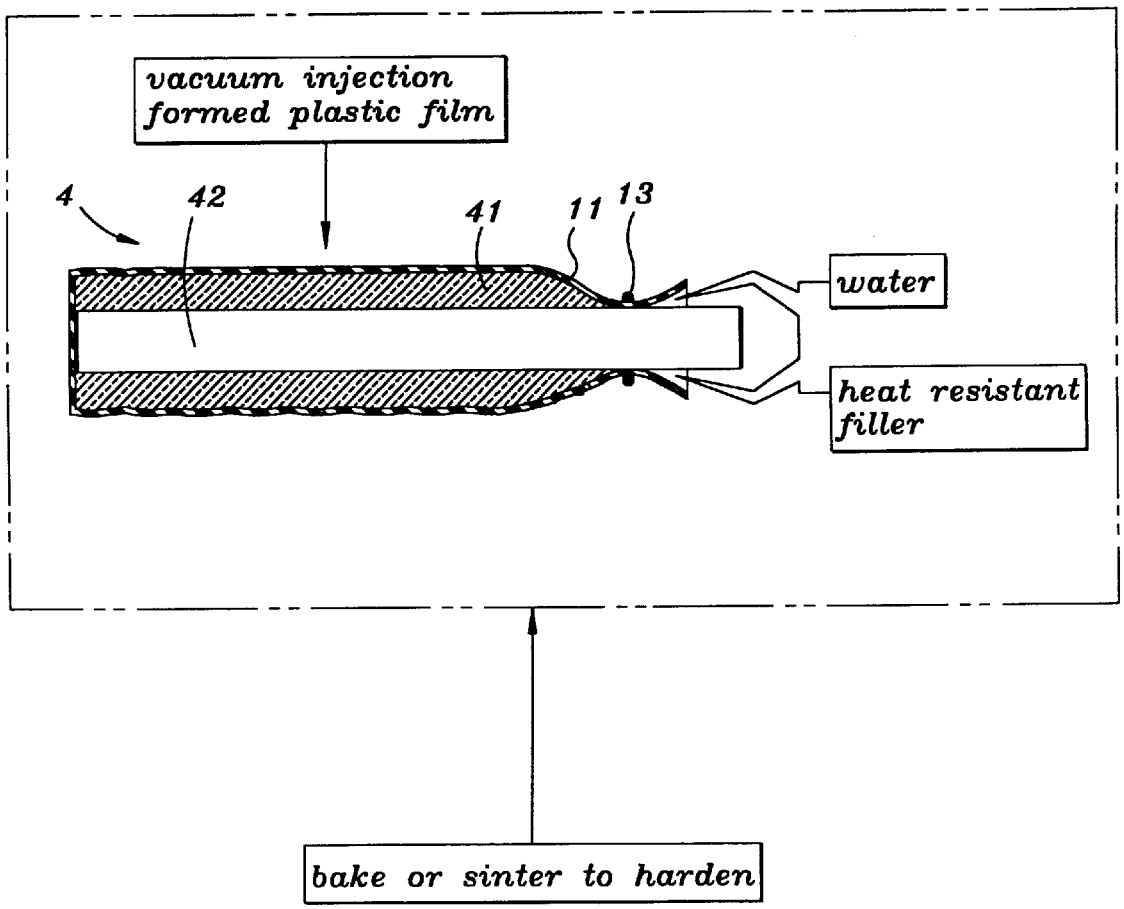
FIG. 11 is a process chart of the hot forging process using a heat resistant die core in the present invention.

Referring to the following drawings, the present invention is now described in detail by the embodiments thereof:

As shown in FIGS. 1, 2 and 11, a hollow can shaped plastic film 11 used in the cold or hot forging process of the present invention is made of PET or PVC plastic material etc. which is formed by the vacuum forming technique. The contour of the plastic film 11 formed by the vacuum injection forming technique is not limited to what is depicted in the drawings which show a net work constructed with a plurality of cross rifle lines (as shown in FIG. 3), in fact, the given contour can also be made by the vacuum forming technique meeting the requirement of variation in the contour to form an artistic pipe (such as by the known PET bottle injection forming technique), in this way, complicated artistic embossed pipes can be easily manufactured; but the sole key strongpoint is that the plastic film 11 formed must leave a tapered space for redundant filler and as a room for thermal expansion and cold contraction of the filler, and an opening 111 is provided for loading of the filler.

Figure 3:
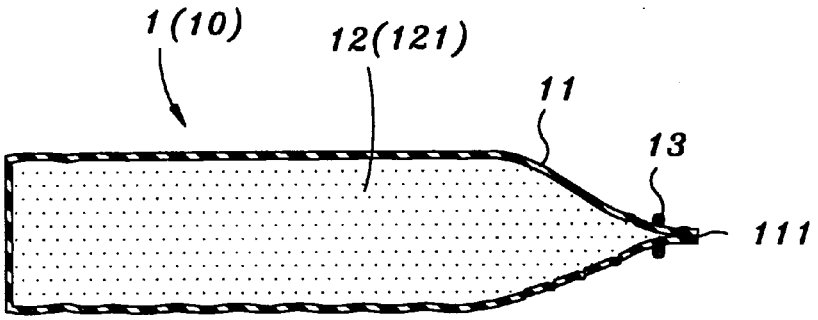
FIG. 3 is a sectional view of the frozen or plastisol filled die core used in the cold forging process of the present invention.

As shown further in FIG. 1, a frozen die core 1 used in the cold forging process of the present invention uses a hollow can shaped plastic film 11 having the desired form, a kind of liquid filler 12 is filled in the plastic film 11 and can be chosen according to the desired forging strength of a metallic pipe shaped casting 2, meterial such as water, iron sand, steel beads or organic starch can be chosen and mixed to form the liquid filler 12 required in the cold forging process; when the liquid filler 12 in the plastic film 11 is in a full load state, as is depicted in FIG. 3, a rope 13 or other measures can be used to seal the opening 111 of the plastic film 11, and fast freezing is carried out under a low themperature of −5° C. to −20° C., this process renders the die core 1 to be frozen, the iron sand or steel beads is provided with high compressive strength, while water mixed with the starch is sticky, so that the iron sand or steel beads after being frozen can be binded together more firmly, yet water solution after being frozen has inherent excellent hardness, so that the frozen die core 1 now has excellent hardness as well as compressive strength, thus is resistive to forging pressure during cold forging.

Another kind of filler 121 which is plastic in the above stated frozen die core 1 can also be made of a hot plastisol mixed in the plastic film 11 with steel beads (as shown in FIG. 2); the melting point of the hot plastisol is about 70 to 100° C., it is mixed with the steel beads and poured into the opening 111 of the plastic film 11 to a nearly saturated state, and the opening is tied as depicted in FIG. 3 by the rope 13 or other measures to seal the opening 111 of the plastic film 11.

The melting point of the plastic film 11 made of PET or PVC plastic material is higher than 100° C., therefore, when the hot plastisol of the temperature of 70 to 100° C. is poured therein, the plastic film 11 will not be deformed or molten, and can form a solid plastisol filled die core 10 after cooling; the hot plastisol has excellent ductility after cooling, and by supporting of the steel beads, thereby it forms a plastisol filled die core 10 with larger forging strength.

Figure 4:
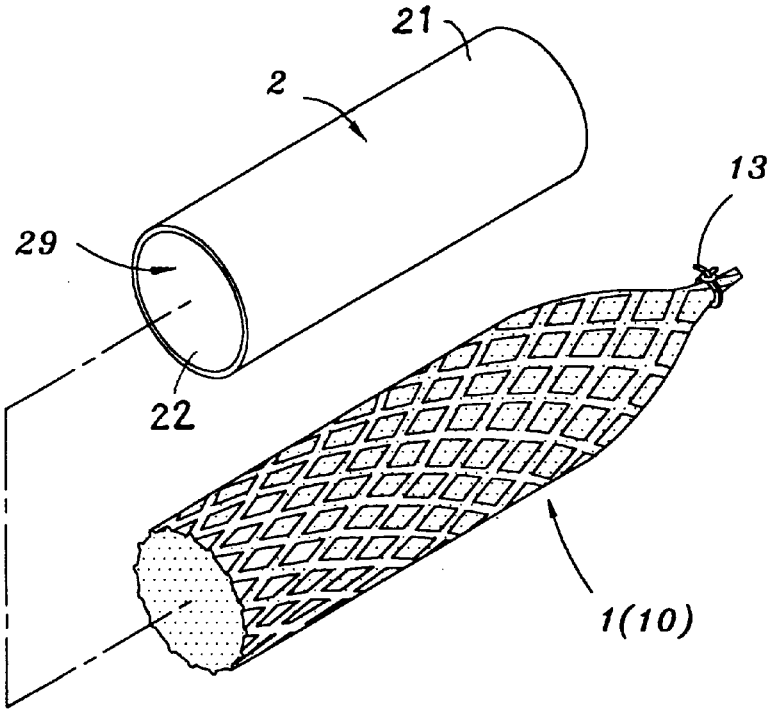
FIG. 4 is an analytical schematic view of the present invention showing insertion of a die core in a metallic pipe shaped casting before cold or hot die forging.
Figure 5:
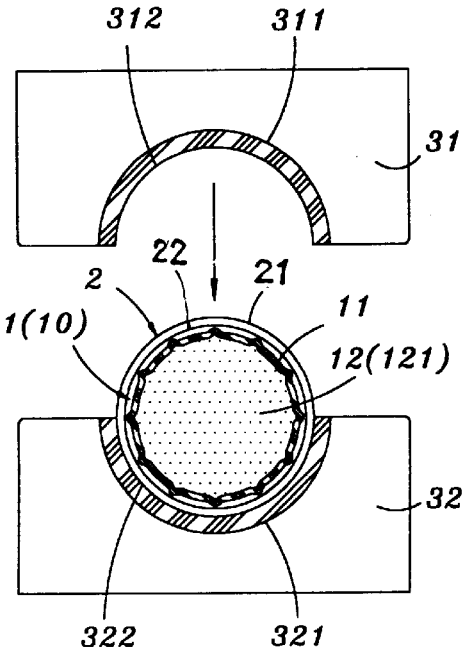
FIG. 5 is a sectional view showing the relationship of an inner and an exterior wall of the casting with the die core in the stage before the cold or hot forging process of the present invention.
Figure 6:
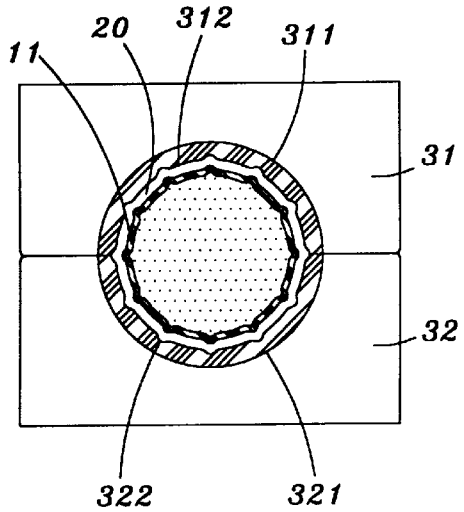
FIG. 6 is a sectional view showing the relationship of the inner and exterior walls of the casting with the die core of the present invention when the parts of the die are closed.

Referring to FIG. 4, taking cold forging as an example (the same is with the hot forging), when the die core 1 or 10 is formed, it is inserted in a pipe hole 29 of the metallic pipe shaped round casting 2, so that all of them can be placed between an upper and a lower die portions 31, 32 on the cold or hot forging equipment to be ready for moulding when the die portions 31, 32 are closed up, such as is shown in FIG. 5, when the metallic pipe shaped casting 2 is to be forged to have shaped inner as well as exterior walls, PU pipe wall-layers 312, 322 must be provided on the walls of the die cavities 311, 321 in the upper and lower die portions 31, 32, so that when the metallic pipe shaped casting 2 is pressed in forging (as shown in FIG. 6), the exterior wall 21 thereof can be formed into the a desired embossed contour by deforming of the PU pipe wall-layers 312, 322 during forging, the PU pipe wall-layers 312, 322 also provide protection for the embossment on the exterior wall of the shaped and embossed pipe 20.

Figure 7:
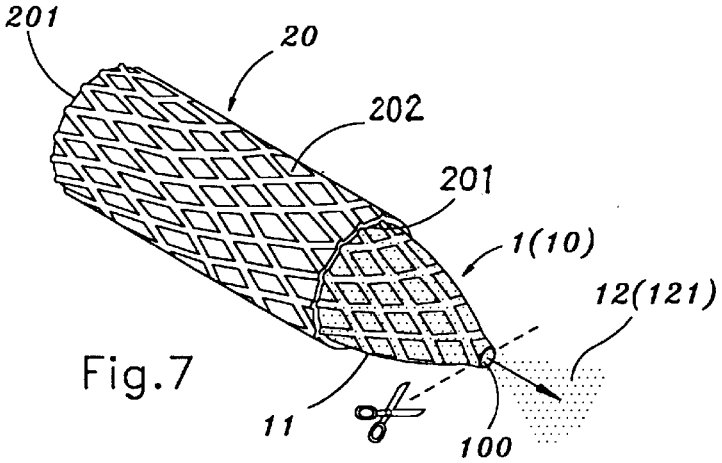
FIG. 7 is a schematic perspective view showing the embossed pipe having the shaped inner and exterior walls made in the process shown in FIG. 5 and FIG. 6 and showing taking out of the frozen or plastisol filled die core of the present invention.
Figure 14:
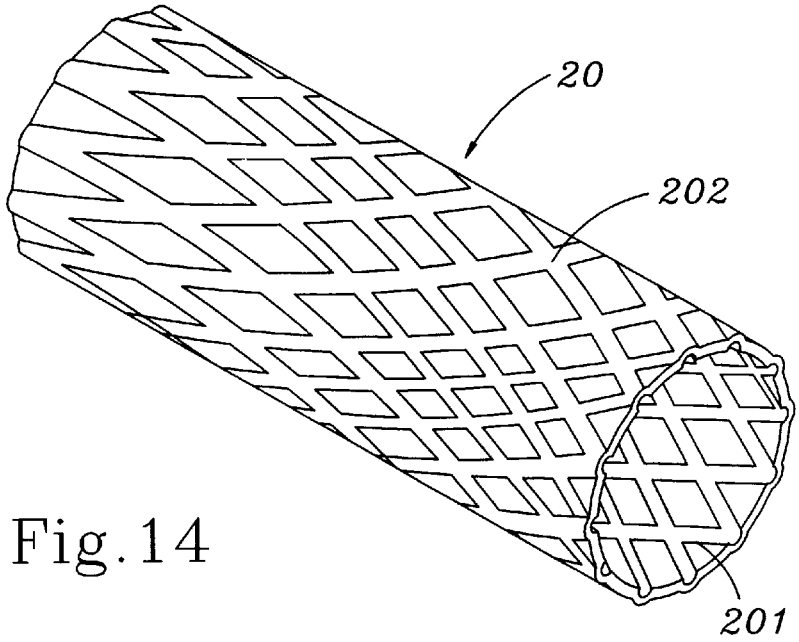
FIG. 14 is a perspective view of the embossed pipe made by the cold or hot forging process and with the die of the present invention with the inner and exterior walls thereof having their respective embossed contours.

Referring to FIG. 7, taking a shaped and embossed pipe 20 having an inner and an exterior shaped pipe wall formed in cold forging as an example, the mode of removing of the frozen die core 1 or the plastisol filled die core 10 from the shaped inner pipe wall 201 is like this, only to cut to remove the seal on the opening of the plastic film 11 to leave a drain port 100, the die core 1 can be automatically defrozen during slight and slow warming under a normal temperature, and the defrozen liquid filler 12 is discharged out of the drain port 100, so that the plastic film 11 is loosened and collapses to allow removing of the plastic film 11 and the liquid filler 12 out of the shaped pipe wall 201; at this time, the plastisol filled die core 10 automatically softens with a melting point of about 70 to 100° C., so that the hot plastisol and the steel beads can be removed from the drain port 100, and the plastic film 11 is loosened and collapses to allow removing thereof, and the shaped and embossed pipe 20 having an inner and an exterior shaped pipe walls 201, 202 is formed thereby as is shown in FIG. 14.

Figure 8:
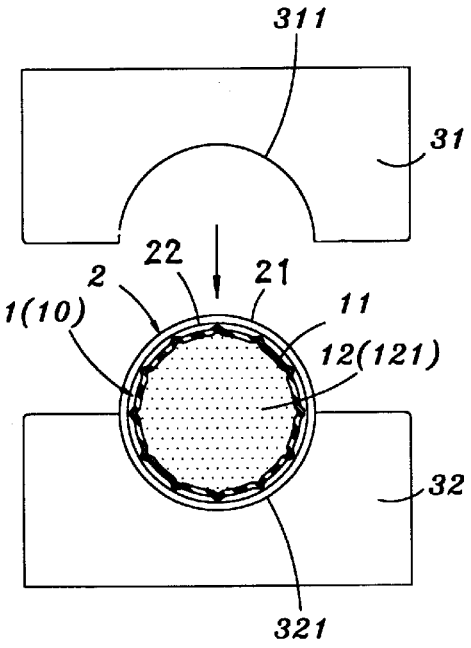
FIG. 8 is a sectional view showing the relationship of the inner wall of the pipe casting with the die core in the stage before the cold or hot forging process of the present invention.
Figure 9:
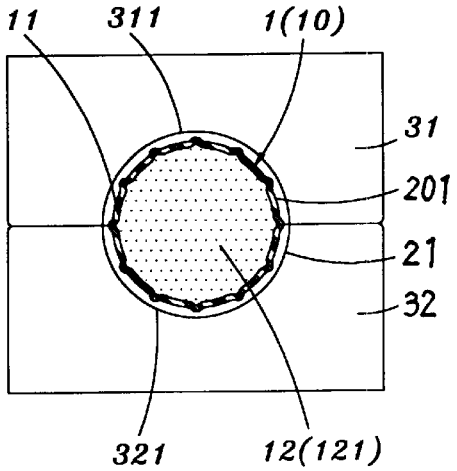
FIG. 9 is a sectional view showing the relationship of the inner wall of the pipe casting with the die core of the present invention when the parts of the die are closed.
Figure 15:
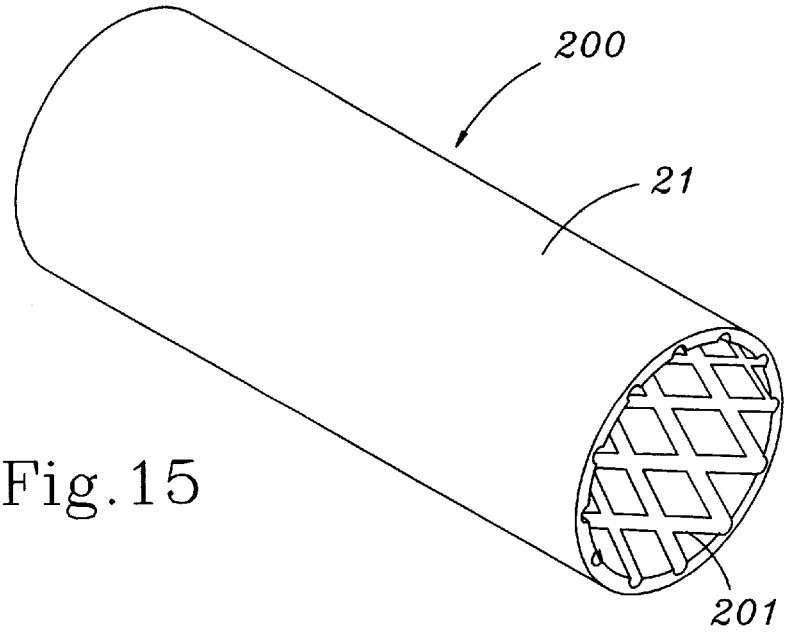
FIG. 15 is a perspective view of the embossed pipe of the present invention with the inner wall thereof having its embossed contour.

Referring to FIGS. 8 and 9, when the pipe shaped casting 2 is to be forged to only have its inner wall endued with a desired shape, the die cavities 311, 321 of the upper and lower die portions 31, 32 are not necessary to be provided with the PU pipe wall-layers, the die cavities 311, 321 only need to be formed to have the similar round surface to that of the exterior wall 21 of the pipe shaped casting 2, so that the exterior wall 21 of the pipe shaped casting 2 can be prevented by the die cavities 311, 321 from deformation during transient forging (as shown in FIG. 9), and the inner wall 22 of the pipe shaped casting 2 can be forged to have the embossed contour of the surface of the die core 1 or 10, meanwhile, the exterior wall 21 is still kept in its original round pipe shape, a shaped and embossed pipe 200 can thus be formed as is shown in FIG. 15.

Figure 10:
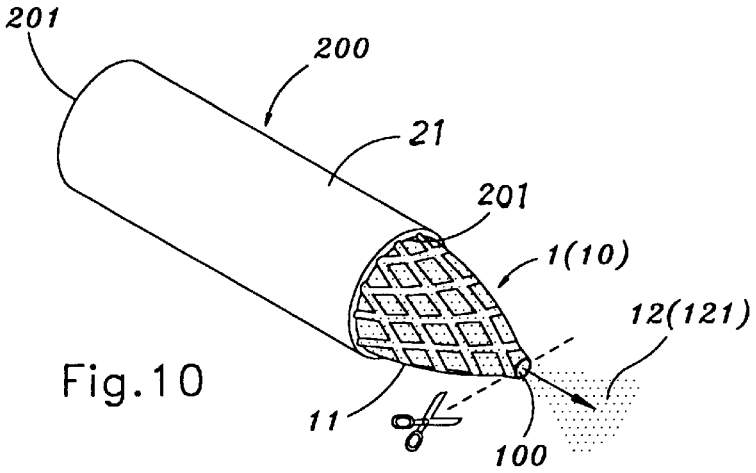
FIG. 10 is a schematic view showing the embossed pipe with the inner wall thereof having an embossed contour after practising of the process shown in FIG. 8 and FIG. 9 and showing taking out of the frozen or plastisol filled die core of the present invention.

And as shown in FIG. 10, the mode of removing of the frozen die core 1 or the plastisol filled die core 10 from the shaped inner pipe wall 201 of the shaped and embossed pipe 200 only having its inner wall endued with a desired shape is done likewise, i.e., to cut to remove the seal on the opening of the die core 1 or 10 to leave a drain port 100, the die core 1 can be defrozen or the die core 10 can be warmed to be softened and then can be taken out.

The die core of the present invention used in hot forging process, as is shown in FIG. 11, is a heat resistant die core 4, it uses also a hollow can shaped plastic film 11 having the desired form to fill therein a kind of heat resistant filler 41 which can be chosen according to the desired forging strength of a metallic pipe shaped casting 2, refractory clay mixed with water can be chosen as the heat resistant filler 41; before the heat resistant filler 41 is filled in the plastic film 11, a heat resistant steel post 42 is inserted in the plastic film 11, then fill the heat resistant filler 41 in the space between the surface of the steel post 42 and the inner surface of the plastic film 11 nearly to the saturated state; then bake or even sinter the heat resistant filler 41 in the plastic film 11 to harden the heat resistant filler 41 and to shape the heat resistant die core 4; temperature for baking or sintering is normally several hundred centigrade degrees, so that water contained therein can be burned out to get the hardened heat resistant die core 4; and in the process of baking or sintering, the plastic film 11 on the surface is gradually molten into and enveloped in the surface of the shaped heat resistant die core 4.

Figure 12:
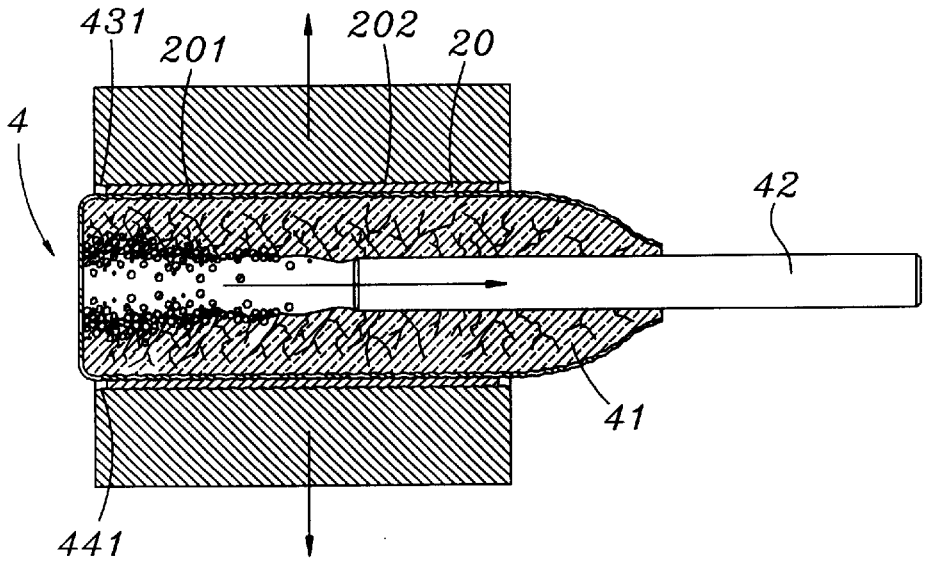
FIG. 12 is a sectional view showing taking out of the heat resistant die core after shaping of the inner and exterior walls of the pipe casting to have respective embossed contours in the hot forging process of the present invention.
Figure 13:
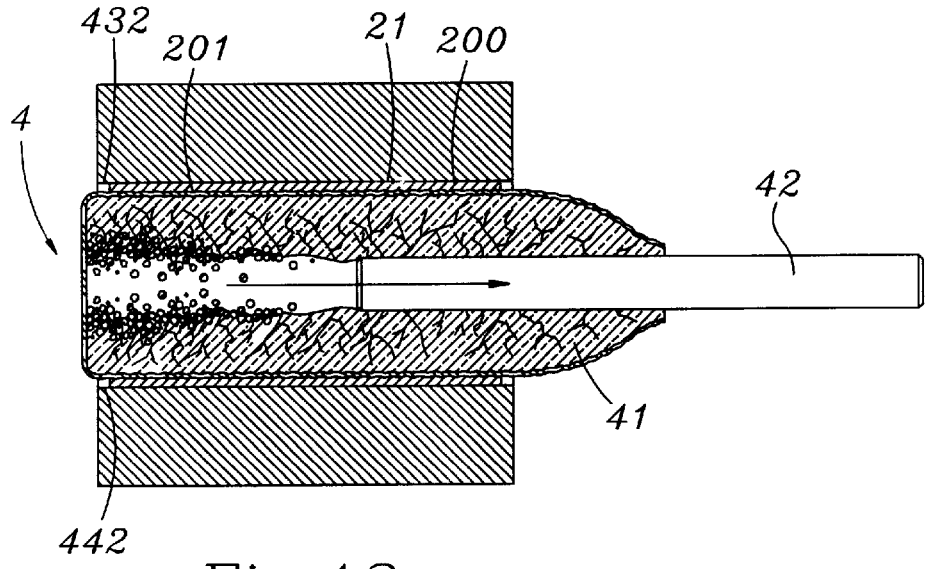
FIG. 13 is a sectional view showing taking out of the heat resistant die core after shaping only of the inner wall of the pipe casting to have an embossed contour in the hot forging process of the present invention.

The heat resistant die core 4 is hardened by baking or even sintering under high temperature, the heat resistant filler 41 is vibrated to pieces by a slight shaking and pulling exerting on the heat resistant steel post 42 enveloped therein, and the heat resistant steel post 42 can then be taken out, at this time, all the heat resistant filler 41 in the shaped inner pipe wall 201 can be shaken off as is depicted in FIGS. 12 and 13. FIG. 12 discloses that after hot forging of the shaped and embossed pipe 20 having an inner and an exterior shaped pipe walls the heat resistant die core 4 is taking out when being shaken and collapsing, meanwhile, the exterior wall 202 of the shaped and embossed pipe 20 is made the desired embossed contour, therefore, in the embodiment shown in FIG. 12, the die cavities 431, 441 used in the hot forging are excavated in advance to form the desired exterior wall of the shaped and embossed pipe 20 which is coincedent with the shape of the heat resistant die core 4, thereby, the shaped and embossed pipe 20 having the inner and exterior shaped pipe walls 22, 21 coincedent with the shape of the heat resistant die core 4 can be completed by forging. FIG. 13 discloses that a shaped and embossed pipe 200 formed in hot forging has only the shaped inner pipe wall 201 specifically embossed, so that the die cavities 432, 442 used in the hot forging are in no case excavated to form a specific shape for the exterior wall 21, i.e., the die cavities 432, 442 need only have the shape in conformity to the pipe shaped casting 2 as is the case in describing of the die cavities 311, 321 for cold forging.

Having thus described my invention, what I claim as new and desire to be secured by Letters Patent of the United States are:

1. A method for forging a die core with a given shape for manufacturing metallic hollow pipes having a thin wall, said method comprises:

using a hollow cylindrical plastic film loaded with a filler, said plastic film is made of PET or PVC plastic material and is formed by a vacuum forming technique so that said plastic film has a given embossed contour, said plastic film has an opening to receive a liquid filler which is frozen to manufacture a frozen die core to be used in an embossed pipe cold forging process as a die core received in a pipe hole of a casting, said die core causes deformation of the wall of said casting to form a shaped pipe wall with embossed contours, said die core is easily removed from said shaped and embossed pipe, said frozen die core is manufactured by mixing water, iron sand, steel beads and organic starch to form a liquid filler in said plastic film, sealing said opening of said plastic film, and fast freezing said filler in said plastic film at a temperature of −5° C. to −20° C. to form said frozen die core with a required hardness as well as compression strength:

said die core is used in forging a pipe shaped casting to make the inner pipe wall or the inner and the exterior pipe walls thereof coincident with the surface shapes of said die core.

2. The method for forging a die core with a given shape for manufacturing metallic hollow pipes having a thin wall as claimed in claim 1, wherein:

said method includes a step of removing said frozen die core from said shaped inner pipe wall by cutting and removing a seal on said opening of said plastic film to leave a drain port, then thawing said frozen die core during blight and slow warming under a normal temperature, thus causing said plastic film to loosen and collapse to allow removing said plastic film and said liquid filler from said shaped pipe wall.

3. A method for forging a die core with a given shape for manufacturing metallic hollow pipes having a thin wall, said method comprises:

using a hollow cylindrical plastic film loaded with a filler, said plastic film is made of PET or PVC plastic material and is formed by a vacuum forming technique so that said plastic film has a given embossed contour, said plastic film has an opening for loading a plastic filler to manufacture a plastisol filled die core to be used in an embossed pipe cold forging process as a die core received in a pipe hole of a casting, said die core causes deformation of the wall of said casting to form a shaped pipe wall with embossed contours, said die core is easily removed from said shaped and embossed pipe, said plastisol filled die core is manufactured by mixing a melted hot plastisol in said plastic film with steel beads to form said plastic filler, sealing said opening of said plastic film so that after cooling, said plastic film filled with said filler forms said desired plastisol filled die core with a suitable hardness and compression strength;

said die core is used in forging a pipe shaped casting to make the inner pipe wall or the inner and the exterior pipe walls thereof coincident with the surface shapes of said die core.

4. The method for forging a die core with a given shape for manufacturing metallic hollow pipes having a thin wall as claimed in claim 3, wherein:

said method includes a step of removing of said plastisol filled die core from said shaped pipe wall by cutting and removing a seal on said opening of said plastic film to leave a drain port, then softening said plastisol by heating said plastisol to approximately 70 to 100° C., thereby melting said plastisol and shrinking said plastisol filled die core and removing said plastisol filled die core through said drain port.

5. A method of forging a die core with a given shape for manufacturing metallic hollow pipes having a thin wall, said method comprises:

using a hollow cylindrical plastic film loaded with a filler, said plastic film is made of PET or PVC plastic material and is formed by a vacuum forming technique so that said plastic film has a given embossed contour, said plastic film has an opening for loading a heat resistant filler to manufacture a heat resistant die core to be used in an embossed pipe hot forging process as a die core received in a pipe hole of a casting, said die core causes deformation of the wall of said casting to form a shaped pipe wall with embossed contours, said die core is easily removed from said shaped and embossed pipe, said heat resistant die core is manufactured by inserting a heat resistant steel post in said plastic film, filling a space between the surface of said steel post and the inner surface of said plastic filling with said heat resistant filler comprised of a refractory clay mixed with water, and sealing said opening of said plastic film, then baking or sintering said heat resistant filler in said plastic film to harden said heat resistant filler and to shape said heat resistant and embossed die core;

said die core is used in forging a pipe shaped casting to make the inner pipe wall or the inner and the exterior pipe walls thereof coincident with the surface shapes of said die core.

6. The method for forging a die core with a given shape for manufacturing metallic hollow pipes having a thin wall as claimed in claim 5, wherein:

said method includes a step of removing said heat resistant die core from said shaped pipe wall by vibrating said heat resistant filler by shaking and pulling on said heat resistant steel post enveloped therein, so that said heat resistant filler is broken into pieces and loosened from said shaped pipe wall so that said heat resistant die core is easily removed.

* * * * *